US009828822B1

(12) United States Patent
Baez

(10) Patent No.: US 9,828,822 B1
(45) Date of Patent: Nov. 28, 2017

(54) BOP AND PRODUCTION TREE LANDING ASSIST SYSTEMS AND METHODS

(71) Applicant: Chevron U.S.A. Inc., San Ramon, CA (US)

(72) Inventor: Mauricio Baez, Sugar Land, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 15/443,419

(22) Filed: Feb. 27, 2017

(51) Int. Cl.

| | |
|---|---|
| ***E21B 33/035*** | (2006.01) |
| ***E21B 23/08*** | (2006.01) |
| ***E21B 33/038*** | (2006.01) |
| ***E21B 33/064*** | (2006.01) |
| ***E21B 23/03*** | (2006.01) |

(52) U.S. Cl.
CPC ..... *E21B 33/0355* (2013.01); *E21B 23/03* (2013.01); *E21B 33/038* (2013.01); *E21B 33/064* (2013.01)

(58) Field of Classification Search
CPC ..... B63G 8/001; B63G 2008/007; B63G 2008/004; B63G 2008/005; B63G 2008/008; B63G 8/08; B63G 8/22; E21B 2023/008; E21B 33/0355; E21B 33/038; E21B 23/03; E21B 33/064
See application file for complete search history.

(56) References Cited

U.S. PATENT DOCUMENTS

| | | | | |
|---|---|---|---|---|
| 3,536,023 | A * | 10/1970 | Bascom | B63B 27/36 114/259 |
| 3,779,195 | A * | 12/1973 | Oeland, Jr. | B63C 7/02 114/51 |
| 3,966,171 | A * | 6/1976 | Hale | B63B 27/36 114/244 |
| 4,010,619 | A * | 3/1977 | Hightower | B63C 11/48 114/322 |
| 4,017,823 | A | 4/1977 | Cooke et al. | |
| 4,280,430 | A * | 7/1981 | Wilson | B63B 22/02 114/51 |
| 4,484,838 | A | 11/1984 | Stevens | |
| 4,502,407 | A | 3/1985 | Stevens | |
| 4,601,608 | A | 7/1986 | Ahlstone | |
| 4,602,893 | A | 7/1986 | Gist et al. | |
| 4,624,318 | A | 11/1986 | Aagaard | |
| 4,704,050 | A | 11/1987 | Wallace | |

(Continued)

*Primary Examiner* — James G Sayre
(74) *Attorney, Agent, or Firm* — Karen R. DiDomenicis

(57) ABSTRACT

Systems and methods are provided to assist with landing a component, e.g. a blowout preventer or production tree, having a female connector onto a male component which may be a mandrel extending from a top portion of the production tree or a wellhead, respectively. Thrusters are located between the component and the mandrel or wellhead, respectively, extending radially and connected to the bottom portion of the component. Activation of a thruster will cause the component to move in a direction away from the activated thruster. Real-time data is collected related to the position of the component relative to the mandrel or wellhead, respectively, and is used to determine which the thrusters to activate. The component is thus caused to move in a desired direction, until the female connector can be lowered onto the male component thereby engaging the blowout preventer or production tree with the mandrel or the wellhead, respectively.

11 Claims, 5 Drawing Sheets

(56) References Cited

U.S. PATENT DOCUMENTS 4,706,119 A 11/1987 Shatto, Jr. et al.
5,042,415 A * 8/1991 Hoffman ..... B63G 8/42 114/322
5,046,895 A * 9/1991 Baugh ..... E21B 41/04 405/188
5,097,780 A 3/1992 Winchester
5,341,884 A 8/1994 Silva
5,823,131 A 10/1998 Boatman et al.
6,257,162 B1 * 7/2001 Watt ..... B63G 8/001 114/221 R
6,260,504 B1 7/2001 Moles et al.
6,390,012 B1 * 5/2002 Watt ..... B63B 27/36 114/322
6,928,947 B1 8/2005 Clapham
6,935,262 B2 * 8/2005 Roodenburg ..... B63C 11/42 114/258
7,296,530 B1 * 11/2007 Bernstein ..... B63G 8/001 114/322
7,481,173 B2 * 1/2009 Pollack ..... B63B 27/36 114/51
7,669,541 B2 3/2010 Horton, III et al.
7,731,157 B2 * 6/2010 Davidson ..... B66D 1/525 114/258
7,854,569 B1 * 12/2010 Stenson ..... B63G 8/001 114/322
8,398,334 B1 3/2013 Doyle
9,387,911 B2 7/2016 Jamieson et al.
9,422,034 B2 8/2016 Bauer et al.
9,534,453 B2 1/2017 Machin et al.
2004/0013471 A1 1/2004 Matthews
2004/0094305 A1 5/2004 Skjaerseth et al.
2005/0276665 A1 * 12/2005 Entralgo ..... B63C 11/42 405/190
2007/0231072 A1 10/2007 Jennings et al.
2007/0272906 A1 * 11/2007 Davidson ..... B66D 1/525 254/270
2009/0308299 A1 * 12/2009 Luccioni ..... B63B 21/66 114/230.23
2010/0189541 A1 * 7/2010 Laenge ..... B66C 13/02 414/803
2010/0212574 A1 * 8/2010 Hawkes ..... B63C 11/42 114/328
2010/0260553 A1 * 10/2010 Bryn ..... B63C 11/42 405/191
2011/0061583 A1 3/2011 MacKinnon
2011/0240303 A1 * 10/2011 Hallundbaek ..... B63C 11/42 166/339
2012/0251243 A1 10/2012 Smith
2012/0266803 A1 10/2012 Zediker et al.
2013/0220625 A1 8/2013 Billington et al.
2014/0038479 A1 2/2014 Johnstone et al.
2015/0132066 A1 5/2015 Phadke et al.
2015/0176236 A1 6/2015 Smith
2015/0211337 A1 7/2015 Younan
2015/0375829 A1 12/2015 Chitwood et al.
2016/0053453 A1 2/2016 Jacobsen
2016/0059939 A1 3/2016 Lamonby et al.
2016/0160463 A1 6/2016 Younan
2016/0176486 A1 * 6/2016 Korneliussen ..... B63G 8/001 114/257

* cited by examiner

BOP AND PRODUCTION TREE LANDING ASSIST SYSTEMS AND METHODS

FIELD

The present disclosure relates to the field of subsea well completion systems and methods and more particularly to systems and methods for landing production tree components onto a subsea well.

BACKGROUND

During subsea well completions, production tree components are landed in place onto previously installed well components. For example, a blowout preventer or stack of blowout preventers (BOP) is landed onto a wellhead or a previously installed production tree. Likewise, the production tree is landed onto a previously installed wellhead. During the landing process, the production tree components must be mated in a subsea environment in which ocean currents and rig movements create forces on the component to be landed. These surrounding forces create a risk of damage to the components to be mated, for instance the BOP, production tree or wellhead gasket, or the stub (male component) that mates with the BOP or production tree connector. Because of this risk, rig time is often spent waiting for these forces to subside before proceeding with landing the equipment. Equipment may also be damaged requiring replacements and associated delays.

There exists a need for systems and methods providing greater assurance that the stub and the connector are aligned when mating subsea production tree components, particularly in such a way as to reduce rig time.

SUMMARY

In one aspect, provided is a system for assisting with landing a component in a subsea well completion system. The component may be either a blowout preventer or a production tree. The system includes a female connector connected to and extending from a bottom portion of the component for engaging a male component which can be a mandrel extending from a top portion of the production tree or a wellhead. At least two thrusters are located vertically between the component and the female connector, extending radially and connected to the bottom portion of the component. Activation of one of the thrusters will cause the female connector to move in a direction away from the activated thruster. The system also includes a means of collecting real-time data containing information on a position of the female connector relative to the male component and a means of receiving the real-time data.

In another aspect, provided is a method for assisting with landing the blowout preventer or production tree in a subsea well completion system using the system described above. According to the method, the real-time data is received and used to determine which of the at least two thrusters to activate and to determine a power level with which to activate the thruster(s). The thrusters are thus activated, thereby causing the female connector to move in a direction away from the activated thruster(s); and the female connector is lowered onto the male component thereby engaging the blowout preventer or production tree with the mandrel on the production tree or the wellhead, respectively.

BRIEF DESCRIPTION OF THE DRAWINGS

These and other objects, features and advantages of the present invention will become better understood with reference to the following description, appended claims and accompanying drawings. The drawings are not considered limiting of the scope of the appended claims. The elements shown in the drawings are not necessarily to scale. Reference numerals designate like or corresponding, but not necessarily identical, elements.

DETAILED DESCRIPTION

Figure 1:
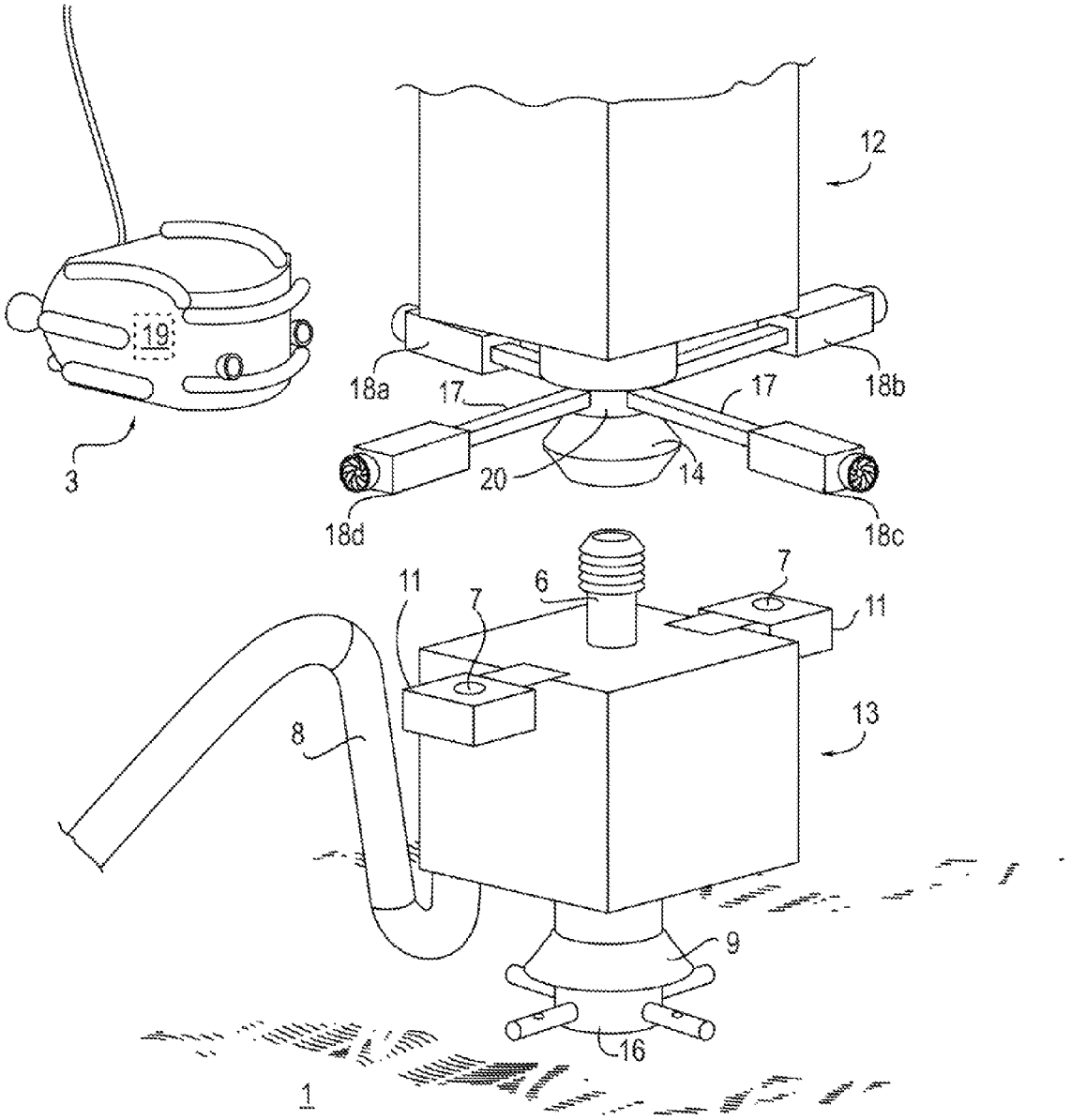
FIG. 1 is a simplified view of systems and methods for landing a blowout preventer on a production tree according to one exemplary embodiment.

Systems and methods for safely landing production tree components on a subsea well will now be described. The production tree components can include, but are not limited to, blowout preventers and production trees in a subsea well completion system. Referring to FIG. 1, in one embodiment, the production tree component, also referred to herein as the component, to be landed on the subsea well is a blowout preventer (BOP) 12. The BOP 12 can refer to multiple blowout preventers in a BOP stack. A female connector 14, also referred to simply as connector 14, extends downwards from a bottom portion of the BOP 12 for engaging a stationary male component in the form of a mandrel 6. The mandrel 6 extends upwards from a top portion of a production tree 13. The production tree 13 can be attached via a tree funnel 9 to a wellhead 16 at a seafloor 1. A jumper 8 can be attached to the production tree 13 as is known for connecting the production tree 13 with a subsea manifold (not shown).

In embodiments, at least two underwater thrusters 18, also referred to simply as thrusters, are located vertically between the blowout preventer 12 and the connector 14. The thrusters 18 extend radially from and are connected to the bottom portion of the blowout preventer 12 from which the connector 14 extends. The thrusters can be placed to provide vertical movement, horizontal movement and a combination of directions in the water. Hydraulically or electrically driven thrusters can be used as are known for use in subsea applications such as for propelling remotely operated vehicles (ROVs). Activation of one of the thrusters 18 will cause the connector 14 to move in a direction away from the activated thruster. In one embodiment, the thrusters 18 are located in a plane relative to one another, therefore activation of one of the thrusters 18 will cause the female connector 14 to move in the plane. In one embodiment, pivotable thrusters 18 are used. By pivotable thrusters is meant that the thrusters 18 are pivotally attached to the bottom portion of the BOP 12. The thrusters 18 may be capable of pivoting horizontally or vertically. In one embodiment, two equidistant thrusters 18 are used. In one embodiment, three equidistant thrusters 18 are used. In another embodiment, as shown, four equidistant thrusters 18*a-d* are used.

Figure 2:
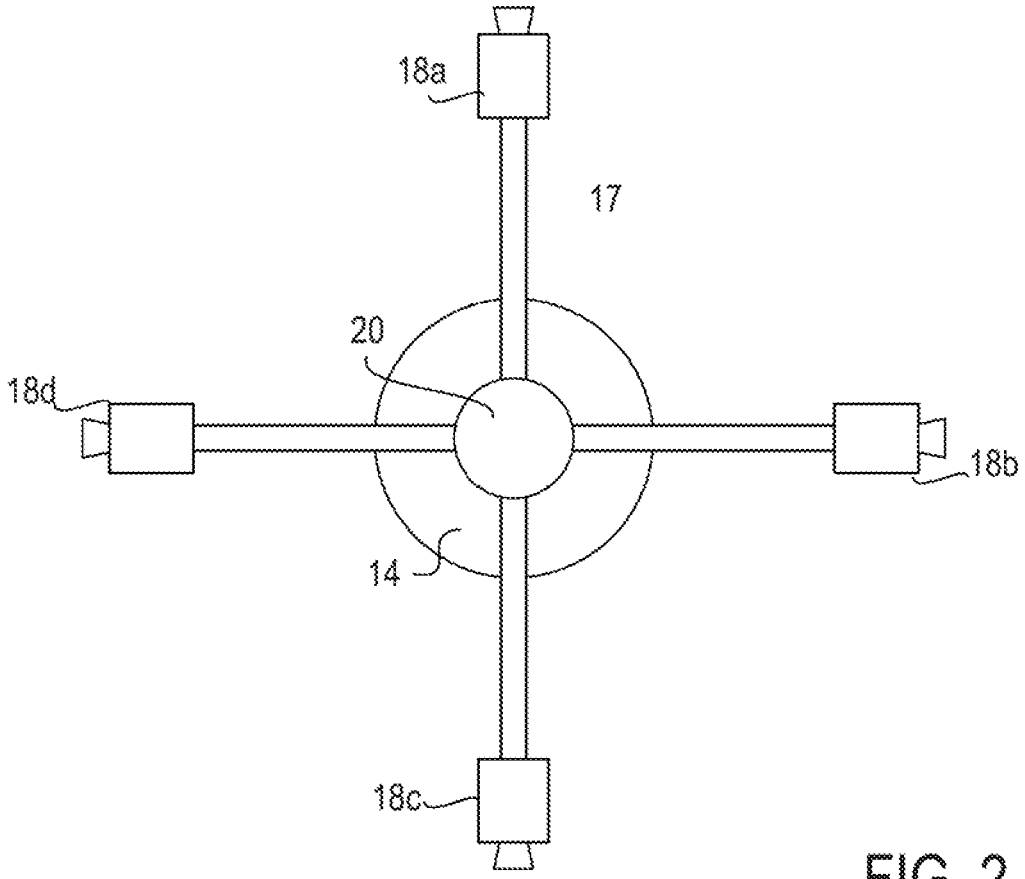
FIG. 2 is a simplified view from below of a thruster array for landing the blowout preventer on the production tree according to one exemplary embodiment.

In one embodiment, the at least two thrusters 18 are activated in response to signals from an integrated gyro unit (not shown) located on the production tree 13 to help position the BOP 12 that is being landed. In one embodiment, the thrusters 18 are attached to a rotatable ring 20 using arms 17 such that the positions of each of the thrusters relative to the blowout preventer 12 can be changed to reposition the thrusters as needed during use. The ring 20 is fixed to the female connector 14 such that its rotation is controlled. FIG. 2 shows a view from below the thrusters 18*a-d* attached to the rotatable ring 20, in turn fixed to the female connector 14.

Furthermore, the connector 14, the thrusters 18 and/or the rotatable ring 20 (if present) can be equipped with optional components such as a depth sensor, an altimeter, a gyro, a camera, sonar or other equipment.

In embodiments, real-time data containing information on the position of the connector 14 relative to the mandrel 6 is collected. The real-time data can include information such as the three-dimensional coordinates, velocity and acceleration of the connector 14. The means 7 for collecting the real-time data can be any of a number of suitable means, including, but not limited to, an upward facing video camera, a sonar sensor or an acoustic sensor. The means 7 of collecting the real-time data can be mounted onto a stable surface at a vertical distance below the upper end of the mandrel 6. As shown in FIG. 1, in one embodiment, the means 7 of collecting the real-time data can be mounted onto a surface of a support 11 bolted onto the production tree 13. When the connector 14 is near the mandrel 6, the means 7 for collecting the real-time data is near enough to detect the presence and position of the connector 14 relative to the mandrel 6.

Figure 3:
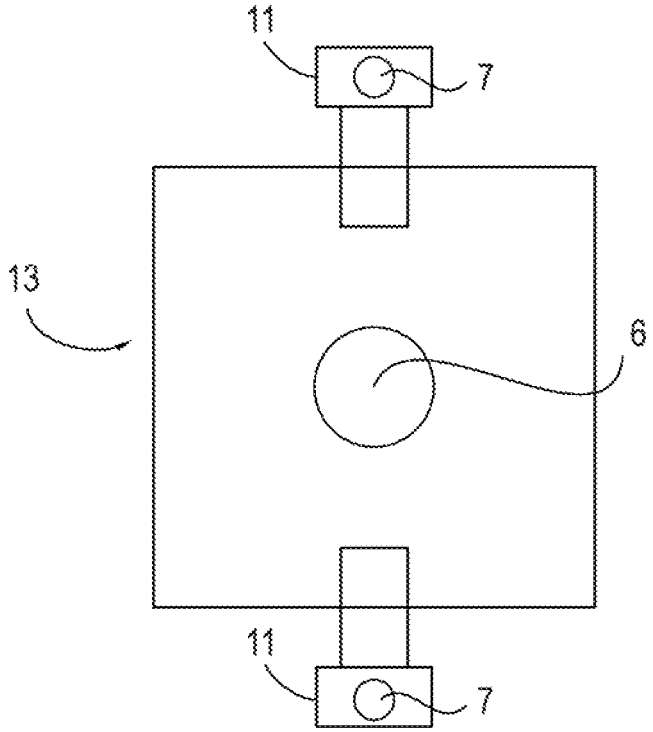
FIG. 3 is a simplified view from above the production tree according to one exemplary embodiment.

FIG. 3 shows a view from above the production tree 13 and mandrel 6 with the means 7 for collecting the real-time data on the production tree 13.

The real-time data collected by the means 7 can be received by a signal receiver 19 in an ROV 3 temporarily located near the means 7. The signal receiver 19 is capable of transmitting the data to a surface user (not shown). In one embodiment, the surface user can be a computer processor or a human operator. The surface user can be located at a topsides location, such as a vessel or a rig, or a remote land-based control location.

The real-time data can be used by the surface user to determine which of the thrusters 18 to activate to achieve the desired movement of the connector 14. The real-time data can also be used by the surface user to determine a power level with which to activate the thrusters 18. In the case of a computer processor, the computer processor performs an algorithm to determine which of the thrusters 18 to activate and a power level with which to activate the thrusters 18 such that the connector 14 aligns vertically with the mandrel 6. At least one of the thrusters 18 is thus activated as determined using the real-time data. The connector 14 is thereby moved in a direction away from the activated thruster(s) 18. Once the center of the BOP 12 is within a measured tolerance relative to the center line of the mandrel 6, then the computer processor provides feedback to an operator so that the connector 14 can be guided and safely lowered onto the mandrel 6, thus landing the BOP 12 on the tree 13.

Figure 4:
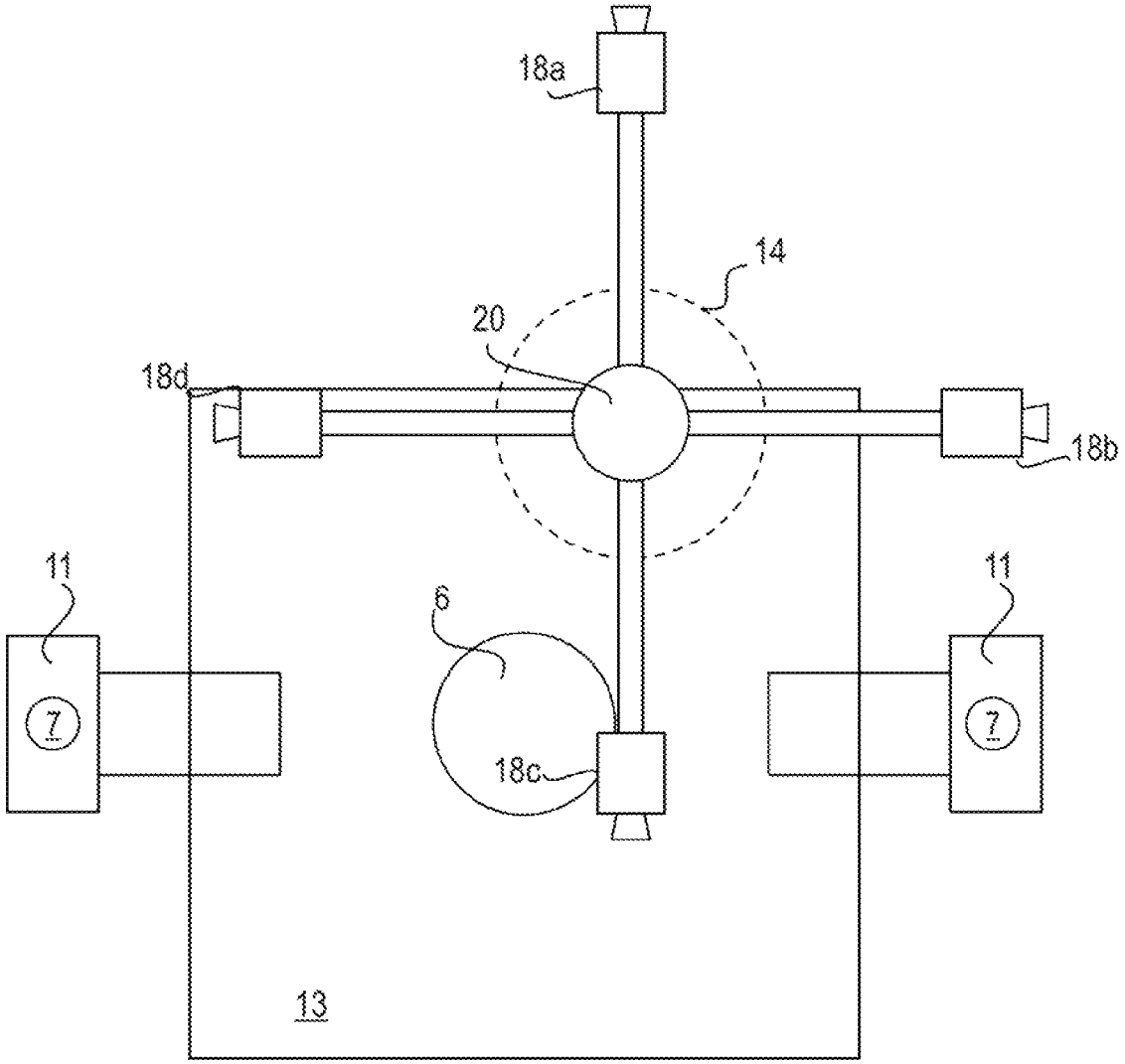
FIG. 4 is a simplified view of the thruster array superimposed on the production tree according to one exemplary embodiment.

FIG. 4 is a simplified view of the thruster array 18*a-d* superimposed on the production tree 13, illustrating the manner of operation of activating the thrusters 18*a-d* selectively to control the positioning of the connector 14 with respect to the mandrel 6. Thrusters 18*a* and 18*b* can be activated to move connector 14 closer to alignment with mandrel 6.

Figure 5:
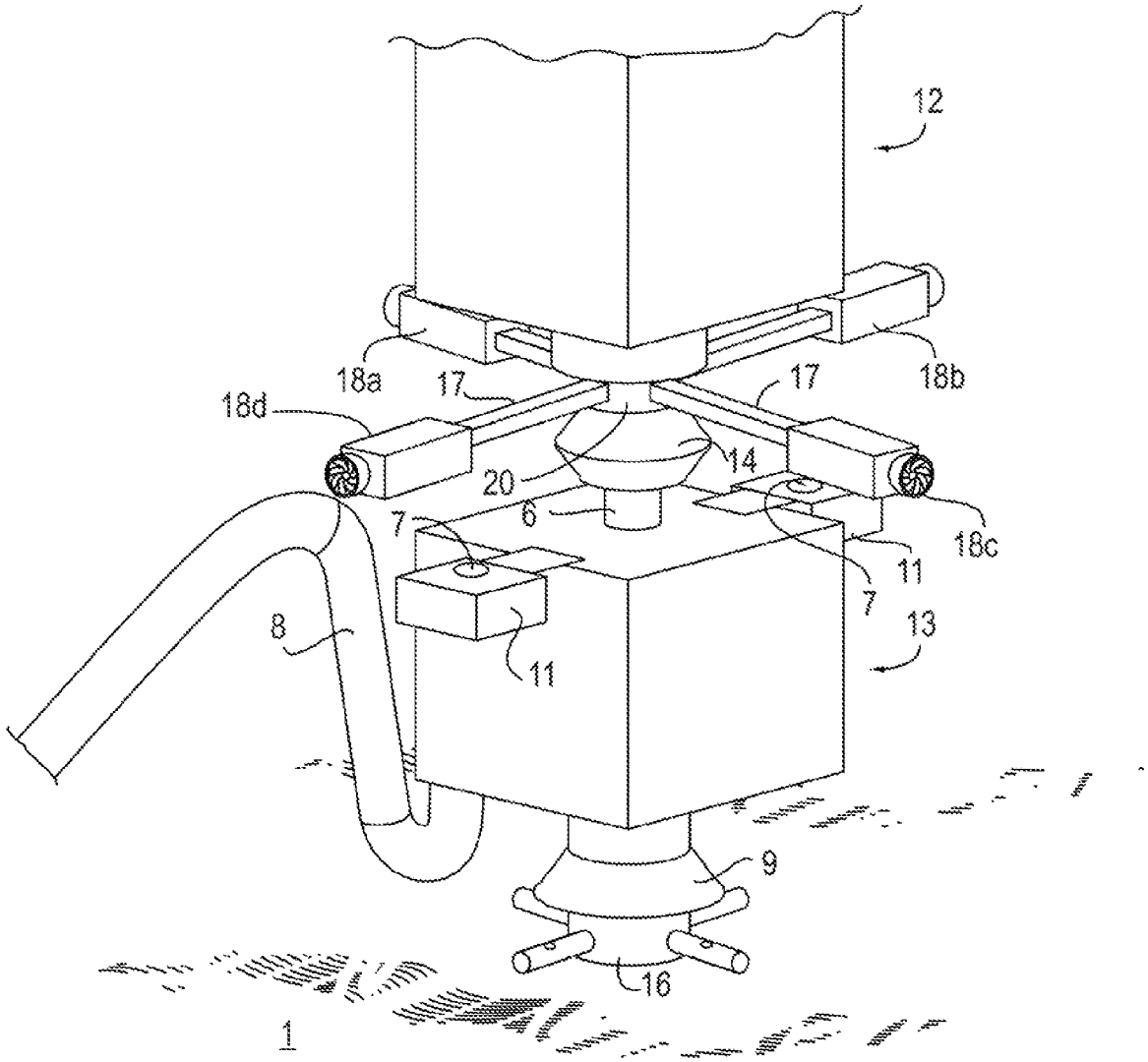
FIG. 5 is a simplified view of the blowout preventer as landed on the production tree according to one exemplary embodiment.

FIG. 5 illustrates the blowout preventer 12 finally landed on the production tree 13. In some embodiments, the thrusters 18 can remain in place. In other embodiments, the thrusters 18 can be removed.

In one embodiment, the blowout preventer (BOP) 12 is landed onto a wellhead directly rather than on the tree 13 in the manner described above.

Figure 6:
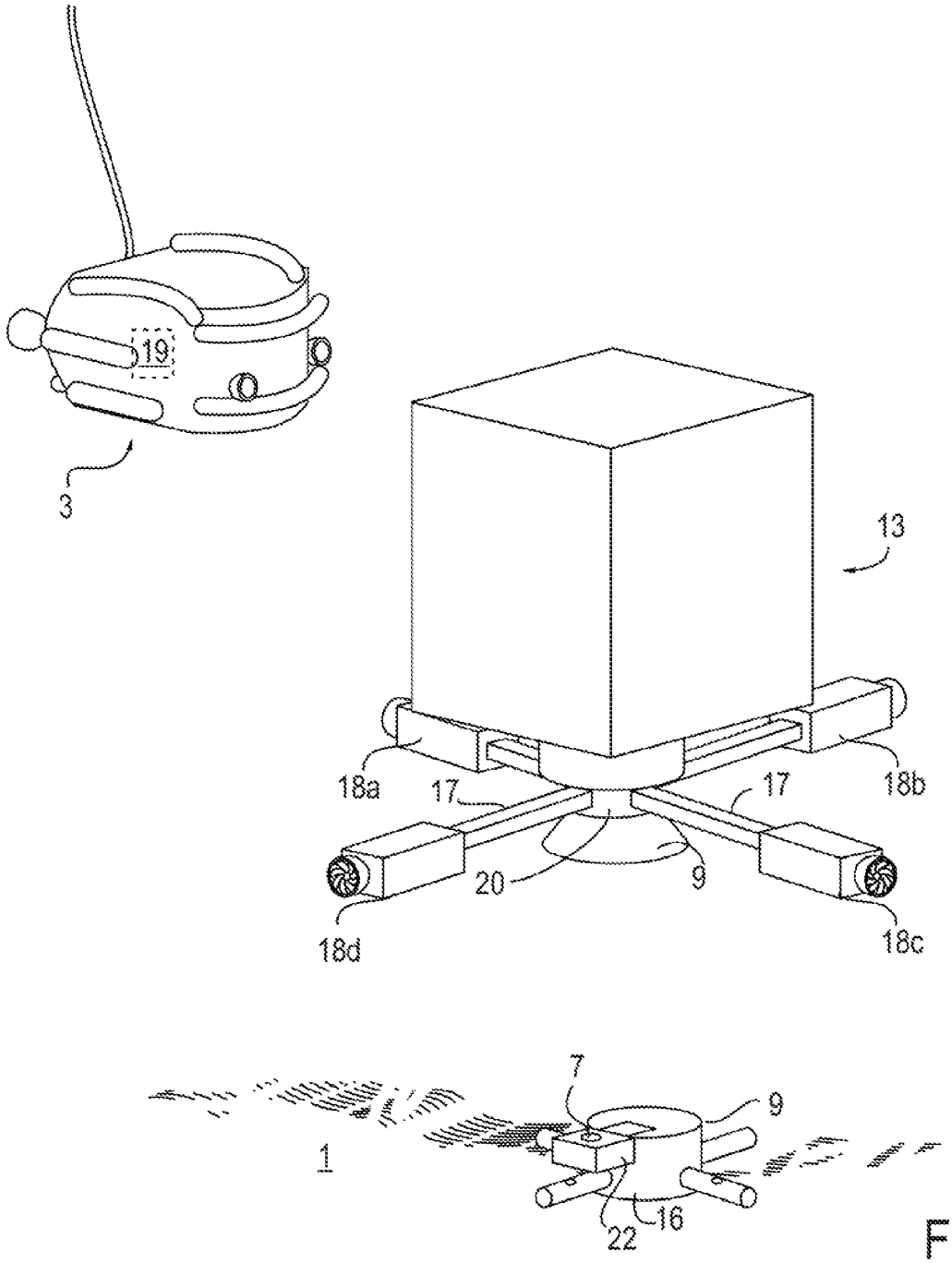
FIG. 6 is a simplified view of systems and methods for landing a production tree on a wellhead according to another exemplary embodiment.

In another embodiment, referring to FIG. 6, the production tree component to be landed is the production tree 13 itself. The connector 14 extends downwards from the bottom portion of the production tree 13 for engaging a stationary male component in the form of a wellhead 16.

Again, at least two thrusters 18 are located vertically between the production tree 13 and the connector 14. The thrusters 18 extend radially from and are connected to the bottom portion of the production tree 13 from which the connector 14 extends. Activation of one of the at least two thrusters 18 will cause the connector 14 to move in a direction away from the activated thruster. The at least two thrusters 18 can be located in a plane relative to one another; activation of one of the at least two thrusters will cause the female connector to move in the plane. In one embodiment, pivotable thrusters 18 can be used. Two, three or four equidistant thrusters 18 can be used. In one embodiment, the at least two thrusters 18 can be attached to a rotatable ring 20 using arms 17 such that the positions of each of the thrusters relative to the production tree 13 can be changed as needed during use.

As described above, real-time data containing information on the position of the connector 14 relative to the wellhead 16 is collected. The means 7 for collecting real-time data can be any of a number of suitable means, including, but is not limited to, at least one upward facing video camera, a sonar sensor and/or an acoustic sensor. The means 7 of collecting data can be mounted onto a stable surface at a vertical distance below the upper end of the wellhead 16. As shown in FIG. 6, in one embodiment, the means 7 of collecting the real-time data can be mounted onto a surface of a support 22 bolted onto the wellhead 16. Again, the real-time data collected can be received by a signal receiver 19 in an ROV 3. The signal receiver 19 is capable of transmitting the data to a surface user. In one embodiment, the surface user can be a computer processor and/or a human operator. As described above, the real-time data is used to determine which of the at least two thrusters 18 to activate and to determine a power level with which to activate the thruster(s) 18. At least one of the thrusters is thus activated as determined using the real-time data thereby causing the connector 14 to move in a direction away from the activated thruster(s) 18. Once the center of production tree 13 is within a measured tolerance relative to the center line of the wellhead 16, then the computer processor provides feedback to an operator so that the connector 14 can be guided and safely lowered onto the wellhead 16, thus landing the production tree 13 on the wellhead 16.

It should be noted that only the components relevant to the disclosure are shown in the figures, and that many other components normally part of a subsea well completion system are not shown for simplicity.

For the purposes of this specification and appended claims, unless otherwise indicated, all numbers expressing quantities, percentages or proportions, and other numerical values used in the specification and claims are to be understood as being modified in all instances by the term "about."

Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

From the above description, those skilled in the art will perceive improvements, changes and modifications, which are intended to be covered by the appended claims.

What is claimed is:

1. A system for assisting with landing a component selected from a blowout preventer and a production tree in a subsea well completion system, comprising:

a. a female connector connected to and extending from a bottom portion of the component for engaging a male component selected from the group consisting of a mandrel extending from a top portion of the production tree and a wellhead;

b. at least two thrusters located vertically between the component and the female connector, extending radially and connected to the bottom portion of the component; such that activation of one of the at least two thrusters will cause the female connector to move in a direction away from the activated thruster and wherein the at least two thrusters are attached to a rotatable ring such that the positions of each of the thrusters relative to the component can be changed as needed during use;

c. a means of collecting real-time data containing information on a position of the female connector relative to the male component; and d. a means of receiving the real-time data.

2. The system of claim 1, wherein the at least two thrusters are located in a plane, and wherein activation of one of the at least two thrusters will cause the female connector to move in the plane.

3. The system of claim 1, wherein the system comprises at least three equidistant thrusters.

4. The system of claim 1, wherein the means of collecting real-time data is selected from the group consisting of at least one upward facing video camera, a sonar sensor and an acoustic sensor, and wherein the means of collecting data is mounted onto a stable surface at a vertical distance below an upper end of the male component.

5. The system of claim 1, wherein the surface user is selected from the group consisting of a computer processor and a human operator.

6. A method for assisting with landing a component selected from the group consisting of a blowout preventer and a production tree in a subsea well completion system, comprising:

a. providing a female connector connected to and extending from a bottom portion of the component for engaging a male component selected from the group consisting of a mandrel extending from a top portion of the production tree and a wellhead;

b. providing at least two thrusters located vertically between the component and the female connector, extending radially and connected to the bottom portion of the component and wherein the at least two thrusters are attached to a rotatable ring such that the positions of each of the thrusters relative to the component can be changed to reposition the thrusters as needed during use;

c. collecting real-time data containing information on a position of the female connector relative to the male component;

d. receiving the real-time data;

e. using the real-time data to determine which of the at least two thrusters to activate and to determine a power level with which to activate the thruster(s);

f. activating at least one of the at least two thrusters as determined in step (e) thereby causing the female connector to move in a direction away from the activated thruster(s); and g. lowering the female connector onto the male component, thereby effecting connection of the blowout preventer or production tree with the mandrel or the wellhead, respectively.

7. The method of claim 6, wherein the at least two thrusters are located in a plane, and wherein activation of one of the at least two thrusters will cause the female connector to move in the plane.

8. The method of claim 6, wherein at least three equidistant thrusters are provided.

9. The method of claim 6, wherein the real-time data is collected by a means selected from the group consisting of at least one upward facing video camera, a sonar sensor and an acoustic sensor, and wherein the means is mounted onto a stable surface at a vertical distance below an upper end of the male component.

10. The method of claim 6, wherein any or all of steps (d) through (f) is performed by a computer processor or a human operator.

11. A method for assisting with landing a component selected from the group consisting of a blowout preventer and a production tree in a subsea well completion system, comprising:

a. providing a female connector connected to and extending from a bottom portion of the component for engaging a male component selected from the group consisting of a mandrel extending from a top portion of the production tree and a wellhead;

b. providing at least two thrusters located vertically between the component and the female connector, extending radially and connected to the bottom portion of the component;

c. collecting real-time data containing information on a position of the female connector relative to the male component;

d. receiving the real-time data;

e. using the real-time data to determine which of the at least two thrusters to activate and to determine a power level with which to activate the thruster(s);

f. activating at least one of the at least two thrusters as determined in step (e) thereby causing the female connector to move in a direction away from the activated thruster(s); and g. lowering the female connector onto the male component, thereby effecting connection of the blowout preventer or production tree with the mandrel or the wellhead, respectively;

wherein any or all of steps (d) through (f) is performed by a computer processor that performs an algorithm utilizing the real-time data to determine which of the at least two thrusters to activate to position the blowout preventer or production tree relative to the mandrel or the wellhead, such that as the blowout preventer or production tree is within a measured tolerance relative to the mandrel or the wellhead, the computer processor provides feedback to the operator so that the blowout preventer or production tree can be safely lowered onto the mandrel or the wellhead in step (g).

* * * * *